United States Patent [19]

Cone

[11] Patent Number: 4,967,613

[45] Date of Patent: Nov. 6, 1990

[54] REVERSIBLE ADJUSTABLE WRENCH

[75] Inventor: Richard E. Cone, Dayton, Ohio

[73] Assignees: SDE Investments, Inc.; Midwest Tool and Cutlery Company, both of Sturgis, Mich. ; a part interest

[21] Appl. No.: 378,043

[22] Filed: Jul. 11, 1989

[51] Int. Cl.[5] ..... B25B 13/16

[52] U.S. Cl. ..... 81/166; 81/175

[58] Field of Search ..... 81/165–168, 81/155, 175, 126

[56] References Cited

U.S. PATENT DOCUMENTS

| | | | |
|---|---|---|---|
| 164,867 | 6/1875 | Norton | 81/175 |
| 1,359,403 | 11/1920 | Lynds | 81/166 |

FOREIGN PATENT DOCUMENTS

| | | | |
|---|---|---|---|
| 34588 | 4/1922 | Norway | 81/168 |
| 670663 | 4/1952 | United Kingdom | 81/166 |

*Primary Examiner*—D. S. Meislin

*Attorney, Agent, or Firm*—Frank H. Foster

[57] ABSTRACT

The subject invention relates to the art of adjustable wrenches. The adjustable wrench of this invention is particularly suited for the gripping of hex head fasteners. The adjustable wrench has a handle portion and a head portion. The head portion has two downwardly extending jaws. One jaw is stationery, the other being moveable. The moveable jaw moves in an elongated slot which is integral with the head portion. The moveable jaw and the elongated slot incorporate opposing interlocking surfaces which cooperate in such a manner as to support the moveable jaw during usage. The moveable jaw is connected to an adjusting means which may be an adjusting screw and an adjusting nut. The adjusting means controls the fixed relationship between the moveable jaw and the fixed jaw. In the embodiment which utilizes an adjusting screw its movement and hence the movement of the moveable jaw is controlled by the rotation of an adjusting nut. The assembly of the moveable jaw into the head portion may be effected through the aperture which contains the adjusting nut. The moveable head, adjusting screw and adjusting nut are fully supported in the head portion. The adjustable wrench of this invention is reversible and may be used in tight quarters. In the preferred embodiment the jaws of the adjustable wrench have 120 degree angled faces.

5 Claims, 2 Drawing Sheets

REVERSIBLE ADJUSTABLE WRENCH

BACKGROUND OF THE PREFERRED INVENTION

1. Field of the Invention

The present invention relates to a reinforced reversible, adjustable wrench which is adapted to grip a hex nut or bolt head on at least four sides. The jaws of the wrench of this invention protrude such that they grip the four surfaces of a hex fastener head in a manner that approximates the gripping action of a socket wrench. The head of the wrench is constructed such that it can grip a hex surface from either side thereby allowing it to be used in such a manner that contact with nearby interfering surfaces is minimized. The head of the wrench has a fixed jaw and an interlocking moveable jaw. The moveable jaw is reinforced by an interlocking slot which is integral with the wrench body. Assembly of the wrench of this invention is effected by inserting the moveable jaw into the thumbwheel aperture and then forward into the interlocking slot.

2. Description of the Prior Art

Adjustable wrenches have been known in the prior art for at least one hundred years. Most prior art adjustable wrenches have two flat planar jaws, one being fixed the other being moveable. These prior art structures are deficient in that the moveable jaw is not adequately supported. The most common forms of these prior art wrenches are the monkey wrench and the Cresent wrench. The latter mentioned Cresent wrench has achieved wide spread commercial acceptance. While Cresent wrenches are widely used they have several serious deficiencies in usage. These deficiencies are the direct result of the layout of the parts which make up this wrench.

A problem with the prior art Cresent wrench is the fact that it is bulky and as such it cannot be used in tight spots.

This bulkiness is the result of the fact that the jaws substantially overlap the hex head of the fastener. As a result of this overlap, if the fastener is in a tight spot or in a recess it is impossible to position the jaws of a Cresent wrench thereon. Further even if it is possible to place the Cresent wrench on a tightly placed hex head it may be impossible to work the wrench in order to achieve the desired tightening or loosening function.

Still a further serious deficiency of the popular Cresent type wrench is the fact that it is capable of gripping a hex surface on only two sides. As a result of this deficient gripping action Cresent wrenches or other similar wrenches with two gripping jaws often slip in usage, thereby creating a situation for possible injury to the user. In accordance with this invention a hex head is gripped on four sides thereby creating a far superior gripping action. Further in many of the prior art structures the components of the wrench are not rigidly interconnected to each other and hence slippage can occur during use thereby allowing for possible failure of the wrench or the injury of the user.

Many attempts have been made in the prior art to overcome the problems as discussed above. Some of these attempts are illustrated in the below discussed patents.

U.S. Pat. No. 2,912.891, Neff, shows an adjustable wrench which is adapted to grip a hex fastener on four sides. Because the moveable jaw is unsupported or hung out, the wrench as shown is subject to breakage or slippage.

U.S. Pat. Nos. 390,422 White, 1,359,403 Lynds, 260,771 Miller disclose prior art wrench structures wherein adjusting screws control the position of moveable jaws.

The U.S. Pat. Nos. 1,359,403 Lynds and 260,771 Miller references further disclose wrench structures which point out the advantages of the wrench of this invention. In the wrench structures of both of these references complicated and elaborate means are utilized in order to reinforce and support the moveable jaw. The Lynds reference shows a wrench which incorporates an adjustable jaw 10 which is secured in wrench body 1 via ribs 5 and 9. In order to permit the assembly of adjustable jaw 10 into wrench body 1, it was necessary to have support rib 5 detachable from adjustable jaw 10. Having a two part support system which must be assembled after the adjustable jaw is inserted into the wrench body is expensive and it is not as strong as a system wherein the support system is integral with the adjustable jaw and the wrench body.

Miller discloses a wrench structure having a moveable jaw B which is inserted into a deformed wrench body. The wrench body must be bent around moveable jaw B by compressing the soft wrench body in a vise. Because the wrench body must be deformed during assembly, it cannot be tempered for strength, is inherently weak and likely to deform again when stress is placed on the moveable jaw during usage.

Both Miller and Lynds point out the advantages of the subject invention. In the subject invention the moveable jaw is fully supported with a support system which is one piece and which is integral with the moveable jaw and wrench body. Further, in the wrench of this invention it is not necessary to deform either the wrench body or the moveable jaw during assembly. Full details of the wrench of this invention will be disclosed hereinbelow, wherein it will be obvious to one skilled in the art that this invention constitutes a clear cut advancement over the prior art.

U.S. Pat. Nos. 12,935 Coburn, 258,673 Preston Hahn 1,361,050 and 325,942 Lancaster show old bulky prior art structures wherein the width of the jaw supports substantially exceeds the width of the gripping jaws thereby creating a structure which can not be used in tight spots.

U.S. Pat. Nos. 2,376,764 Flower and 4,520,699 Jeremic again show adjustable wrench structures wherein the posts which dictate the width of the wrench substantially exceed the jaw width, thereby preventing these wrenches from being used in tight spots.

From the above discussion it can be seen that many efforts have been continuously made in an attempt to produce an adjustable wrench which will securely grip a hex fastener. Further efforts have been made to produce an adjustable wrench which can be used in close quarters and used on nuts or bolts in recesses.

None of the above discussed prior art suggests the present inventive combination of component parts arranged and configured in order to produce an adjustable wrench which is strong, easy to use, can be used in tight quarters, fully grips the hex nut or bolt head on four sides, and wherein the moveable jaw uniquely interlocks with the wrench body in all directions. Further the prior art devices do not provide the benefits which are achieved by the present invention. These benefits are achieved through a new, useful and unobvious combination of component parts at minimal cost and through the utilization of parts which can be easily assembled into a highly useful adjustable wrench.

Therefore, it is an object of this invention to provide and an adjustable wrench which can be used in close quarters, in recesses and can be reversed if a nearby surface interferes with the movement of the handle.

It is yet another object of this invention to provide a simple yet strong method to assemble an interlocking moveable jaw into the wrench body by insertion of said moveable jaw through an adjusting thumbwheel aperture and into a supporting slot.

It is a further object of this invention to provide an adjustable wrench wherein either the main gripping jaws or the rear opening of the head may each grip four sides of a nut or bolt for improved gripping power and greater access.

It is yet another object of this invention to provide an adjustable wrench which may be reversed in order to grip a hex fastener head from either side of the wrench.

Lastly, it is an object of the invention to provide a strong adjustable wrench wherein all of the functional components are interlocked during usage and in Particular the moveable jaw is fully supported in order to resist undesired movement in any direction during usage.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purpose of summarizing the invention, the invention may be defined as a reversible. adjustable wrench having a handle portion and a head portion. The handle portion is of such a size that it can be readily gripped by a human hand. The head portion has a pair of jaws which extend downward from the body of the wrench. The head portion is of such a configuration that it firmly grips four sides of the hex head which are being gripped.

One jaw of the head portion is moveable and is associated with an adjustment mechanism whereby the relationship between the fixed jaw and the moveable jaw may be controlled and thereby the working width of the jaws can be varied. All component parts of the adjustment mechanism in the head portion are rigidly connected to each other and are fully interlocking. The moveable jaw is fully supported in an interlocking slot which is integral with the wrench body. In a preferred embodiment of this invention, the interlocking slot is a dovetail.

The wrench of this invention is reversible and as such either side of the wrench head may be used to grip the hex head of a fastener. Further the wrench of this invention has jaws which extends downwardly in such a manner that the wrench can be used to grip hex surfaces which are in recesses. The head of the wrench opposite of the downwardly extending jaws is flush and as such can also be used to grip hex surfaces.

In one embodiment of this invention, assembly of the wrench is effected by placing the moveable jaw into the adjusting thumbwheel aperture and moving the moveable jaw forward into engagement with the adjacent narrower interlocking slot of the wrench body. The thumbwheel is then placed in the adjusting thumbwheel aperture and assembly completed by screwing the adjusting screw through the handle portion of the wrench body, through the thumbwheel and into the base of the moveable jaw. The interlocking slot and thumbwheel aperture have carefully defined dimensions.

The handle portion of the wrench is angularly disposed to the head portion in such a manner that clearance is provided for the hand of the user when the wrench is used in tight quarters.

The opening formed between the two jaws allows the wrench to be placed over long bolts or similar protruding objects, which can then extend through this opening without obstruction, thereby permitting the jaws to reach the nut.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other apparatus for carrying out the same purposes of the present invention. It should also be realized by those skilled in the art that such equivalent apparatus does not depart from the spirit and scope of the invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which.

DETAILED DESCRIPTION OF THE INVENTION

Figure 1:
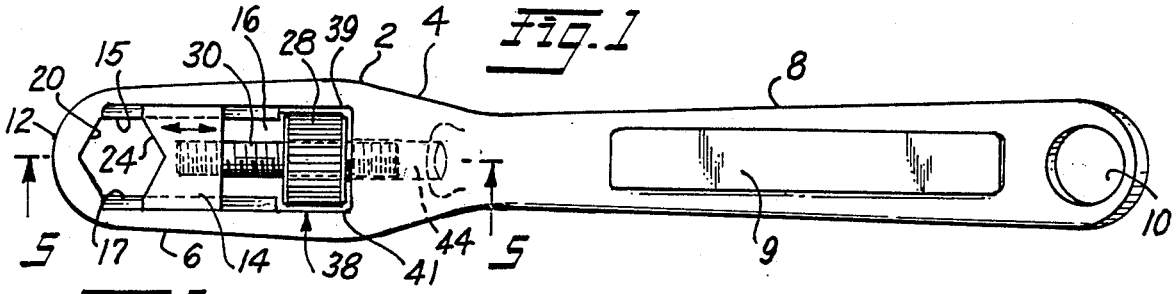
FIG. 1 is a top plan view showing the adjustable wrench of this invention.

Referring to FIG. 1 it can be seen that adjustable wrench 2 incorporates an elongated body section 4 into which the component parts are fitted. Body section 4 is metallic and in accordance with the preferred embodiment of this invention is formed from a cast, forged or machined ferrous alloy. For maximum strength in accordance with the most preferred embodiment body section 4 comprises a high strength forging. After finishing body section 4 may be nickel chrome plated for aesthetic purposes and corrosion resistance.

Body section 4 is divided into a head portion 6 and a handle portion 8. The dimensions of handle portion 8 are such that it is adapted to be gripped by a human hand. For example, an adjustable wrench having an overall length of eight inches, which is adapted to grip hex fastener heads of from 3/16 to ¾ inch, it has been found that handle portion should be about 6 inches long, about 1" inch wide and about ¼ inch thick. The handle further incorporates an aperture 10 which allows adjustable wrench 2 to be hung up when not in use.

Figure 2:
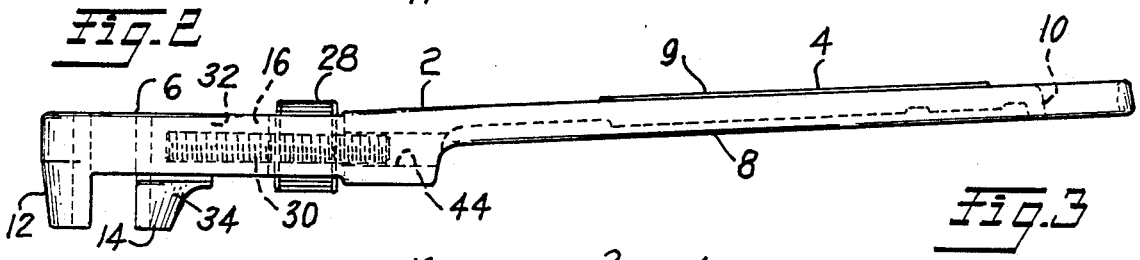
FIG. 2 is a side view of the adjustable wrench of this invention.

As shown in FIG. 2, handle portion 8 may be disposed at an angle of about 4 degrees to the axis of head portion 6. This angular placement allows clearance for the user's hand and use in close quarters without injuring the user.

Handle portion 8 further incorporates a rectangular raised section 9 as shown in FIGS. 1 and 2. Raised section 9 is useful in that it provides a convenient place wherein trademarks and tradenames may be located on wrench 2.

In usage the adjustable wrench of this invention may be used from either side of head portion 6, that is, jaws 12 and 14 can be placed directly on a hex head or the wrench can be flipped over and the aperture which is defined by sides 18, 20, 22 and 24 placed over the hex head. This reversible feature permits the adjustable wrench to be used in tight quarters or around corners that might otherwise be inaccessible due to the protrusion of jaws 12 and 14 and/or the shape of elongated body 4. The angular shape of said body 4, in conjunction with the rear of jaws 12 and 14, also allows the wrench to reach around corners and into tight spaces not accessible to other adjustable wrenches.

As is illustrated in FIGS. 1. 2, 4 and 5, a plurality of component parts are fitted into and incorporated in head portion 6. The terminal end of head portion 6 comprises a fixed downwardly extending jaw 12. Associated with fixed jaw 12 is a moveable jaw 14. During assembly moveable jaw 14 is placed into adjusting thumbwheel aperture 38 and slid forward into engagement with adjacent interlocking slot 16, each of the openings being formed as an integral part of head portion 6. With the placement of moveable jaw 14 in elongated slot 16 this jaw is adapted to slide back and forward in relation to fixed jaw 12 along the axis of interlocking slot 16. As a result of this movement jaws 12 and 14 can be adjusted in relation to each other in such a manner as to grip various sizes of hex fastener heads. The inner faces of jaws 12 and 14 comprise faces 18,20,22 and 24. Pairs of faces 18 and 20 and 22 and 24 are disposed in relation to each other at an angle of 120 degrees. This face angle of 120 degrees allows jaws 12 and 14 to grip opposing sides of a hex fastener head.

Figure 5:
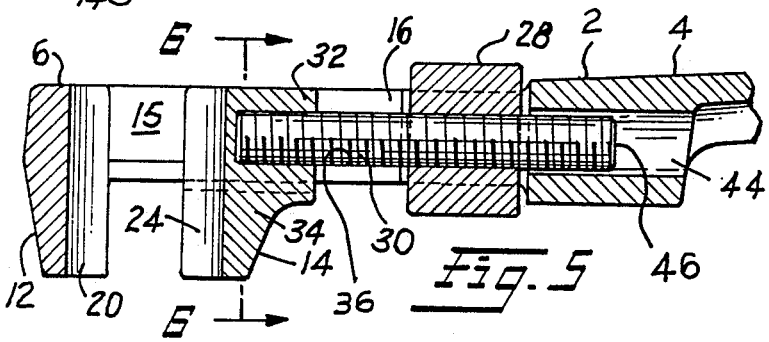
FIG. 5 is a section view along line 5—5 of FIG. 1 showing the details of the head portion of the adjustable wrench of this invention.
Figure 4:
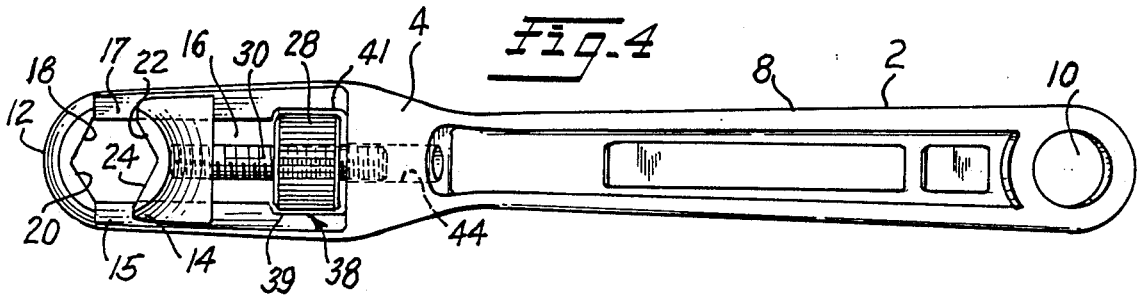
FIG. 4 is a bottom view of the adjustable wrench of the invention.

Referring to FIGS. 2 and 5, it can be seen that moveable jaw 14 further has a protruding end 34 and an interlocking end 32. The width of protruding end 34 is approximately the same as the width of head portion 6. The overall width relationship of jaw 14 to head portion 6 in the preferred embodiment is best illustrated in FIGS. 4. 6, 7 and 8. Moveable jaw 14 and opposing jaw 12 form a functional "socket" that extends beyond the body of the wrench. Because the sides of moveable jaw 14 do not protrude beyond the sides of head portion 6 in the preferred embodiment, adjustable wrench 2 can be used in tight spots. Interlocking end 32 has approximately the same cross-section as interlocking slot 16. The cross-section width of interlocking end 32 must be only slightly smaller than the width of elongated slot 16 in order to allow jaw 14 to move freely in slot 16 and yet allow slot 16 to support jaw 14. In order to allow this movement, while maintaining an adequate support relationship, a difference in size between interlocking slot 16 and interlocking end 32 of about 1 to 5 mils has been found to be desirable.

As can be seen from the cited prior art and the patents as are discussed above, many prior art wrenches incorporate a fixed jaw and a moveable jaw which is capable of being locked into a fixed relationship with the fixed jaw. Because the fixed jaw is integral with the wrench body there is no problem with its structural integrity. In contrast there has been a chronic problem in the prior art with the structural integrity of the moveable jaw of wrenches of the subject type. As is discussed above, in order to allow the moveable jaw to function clearances must be provided between the wrench body and the moveable jaw.

In the prior art structures it was likewise necessary to have clearances between the working parts. As a result of these clearances the component parts of the prior art wrenches twist out of relationship with each other in usage. In contrast, the dovetail interlocking structure of the wrench of the subject invention maintains the moveable jaw in a vertical position regardless of the necessary manufacturing clearances. In fact the dovetail embodiment of this invention permits manufacture with greater clearances or "slop", as in usage these clearances are taken up by the wedge action of the dovetail.

In the prior art the moveable jaw is placed in a non interlocking slot, the edges of which are parallel with the corresponding edges of the moveable jaw. This arrangement allows for slippage between the moveable jaw and the wrench body and hence slippage between the wrench and the head of the fastener which is being adjusted. This slippage can result in serious injury to users of prior art wrenches. These disadvantages of the prior art are overcome in accordance with this invention by providing a unique interlocking relationship between the adjustable jaw and the wrench body. In the wrench of this invention the moveable jaw 14 is locked in a secure relationship with the fixed jaw 12 and further the movement of moveable jaw 14 in relation to fixed jaw 12 and head portion 6 is prevented. This end is accomplished by providing cooperating interlocking surfaces on head portion 6 and moveable jaw 14.

As can be seen in FIGS. 1, 4, 5 and 6, elongated slot 16 is provided with a pair of female interlocking dovetail surfaces 15 and 17.

Figure 6:
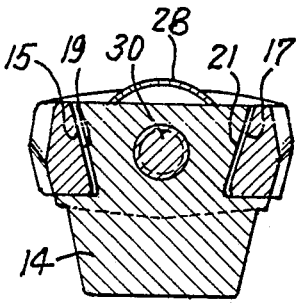
FIG. 6 is a section view along line 6—6 of FIG. 5 showing the details of the dovetail support for the moveable jaw.

In FIG. 6, it can be seen that moveable jaw 14 incorporates a pair of male interlocking surfaces 19 and 21.

In the preferred embodiment when lateral thrust is placed on moveable jaw 14 during usage, this thrust is translated into downward force. The angular pairs of dovetail surfaces 15, 19, 17 and 21 then cooperate with each other in a unique downward wedging manner causing the moveable jaw to self center in a vertical plane within interlocking slot 16. This self centering prevents the twisting of jaw 14, and hence prevents the slippage of the wrench on a hex fastener head. As the lateral force on jaw 14 increases, the contact between the opposing dovetail surfaces increases thereby increasing the resistance to the twisting movement of jaw 14.

For purposes of this invention, a dovetail is defined as a two part system having a wedge shaped male part, called a tenon, which fits into a female wedge shaped part, called a mortise. It is understood by one skilled in the art that hybrid structures incorporating part dovetail and part right angle interlocking surfaces may be used in the wrench of this invention.

The dovetail embodiment of an interlocking surface as is illustrated in FIG. 6 is the preferred embodiment for use in accordance with this invention. A dovetail interlocking relationship is preferred, as when lateral forces are applied to moveable jaw 14 this force is then translated into a downward force which is evenly distributed between both dovetail surfaces; that is. between surfaces 15 and 19 and 17 and 21 as is illustrated in FIG. 6. This interaction of the interlocking dovetail surfaces keeps the axis of moveable jaw 14 parallel with the axis of fixed jaw 12 even when stress is placed on moveable jaw 14 during usage.

Figure 3:
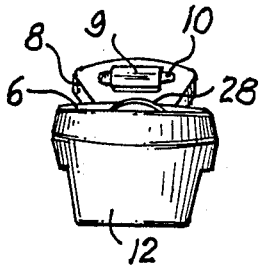
FIG. 3 is a front end view of the adjustable wrench of the invention.

The cooperation of the opposing dovetail surfaces in order to keep opposing jaws 12 and 14 in axial relationship with each other is particularly important when the wrench jaws extend downward from the wrench body as is illustrated in FIG. 2, 3 and 5. In wrench 2, jaws 12 and 14 extend downward from the wrench body approximately ¾ of an inch. If desired, this extension of jaws 12 and 14 below the wrench body can be increased and still maintain the axial relationship of these jaws, because the wrench of this invention has cooperating dovetail surfaces.

The angle of the dovetail surfaces of elongated slot 16 and moveable jaw 14 can be from about 7 to about 45 degrees from vertical. All such other angular references are from the vertical, unless otherwise stated. A more preferred usage is between 7 and 20 degrees with the most preferred dovetail angle being 15 degrees.

Figure 8:
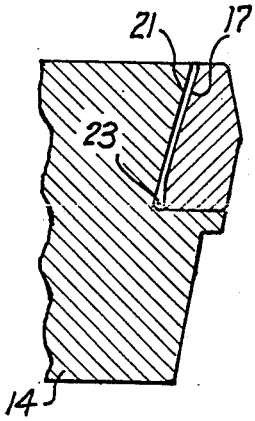
FIG. 8 is an enlarged sectional view showing details of the chamfer.

From FIG. 8 it can be seen that the bottom edge of female dovetail 17 may be chamfered at 23 in order to permit the easy formation of slot 16 in the wrench body. Chamfered edge 23 further prevents the binding of jaw 14 in the wrench body when extreme lateral force is placed on moveable jaw 14.

Figure 7:
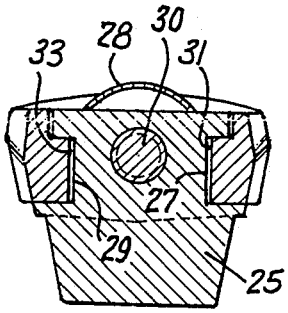
FIGS. 7, 7A, 7B, 7F and 7G are section views showing variations of interlocking supports for the moveable jaw.
Figure 7A:
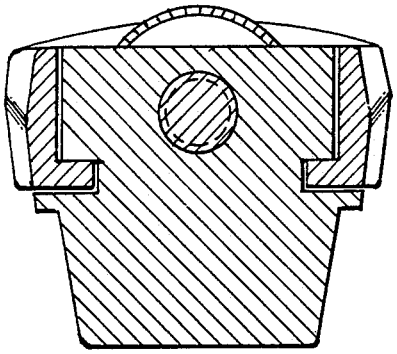
Figure 7B:
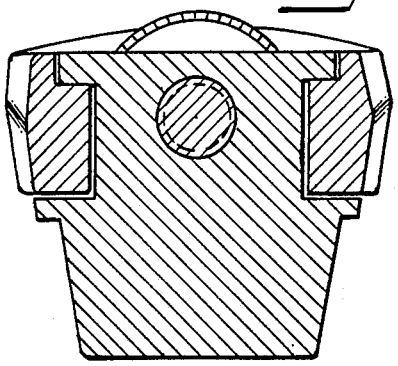
Figure 7C:
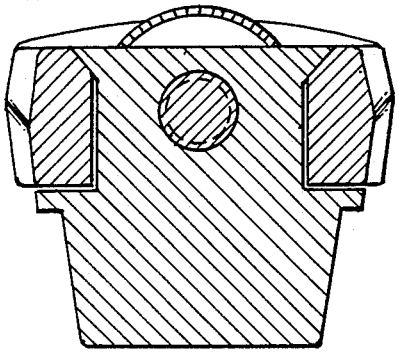
FIG. 7C, 7D, and 7E are section views showing alternate interlocking dovetail supports for the moveable jaw.
Figure 7D:
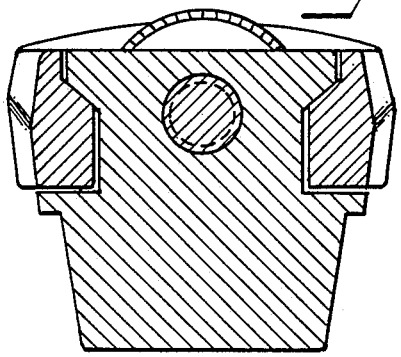
Figure 7E:
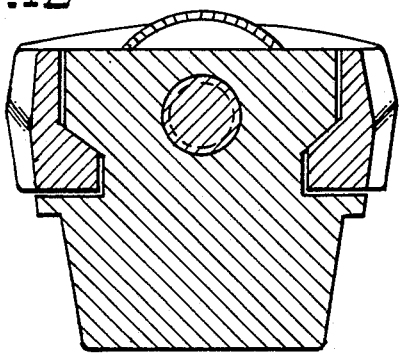
Figure 7F:
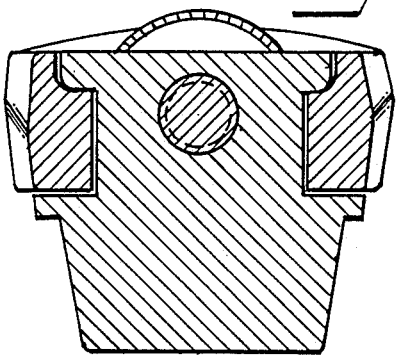
Figure 7G:
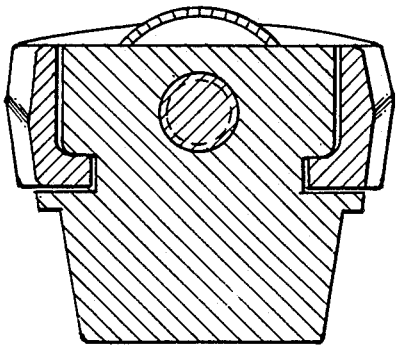

FIGS. 7A to 7G illustrate other embodiments of interlocking surfaces which may be inserted through the thumbwheel aperture of this invention. FIGS. 7C, 7D, and 7E show other dovetailed interlocking cross-sections. FIGS. 7, 7A, 7B, 7F and 7G show non-dovetailed interlocking cross-sections, comprised of right angle interlocking surfaces. In FIG. 7, moveable jaw 25 cooperate a pair of right angle made male surfaces 27 and 29 which cooperate with female non-dovetail interlocking surfaces 31 and 33 which are integral with the wrench body.

From the above description, it is obvious that the interlocking surfaces which can be used in this invention can be of a variety of configurations, although the dovetail configuration alone afford the self centering characteristic discussed above.

Moveable jaw 14 is moved in relation to and biased in a fixed relationship to fixed jaw 12 by an adjustment means. Any convenient adjustment means can be utilized in the wrench of this invention. In accordance with the preferred embodiment the movement of jaw 14 is effected via an adjustment screw. In this embodiment moveable jaw 14 is attached to threaded adjusting screw 30. This attachment is shown in detail in the sectional view of FIG. 5. While adjusting screw 30 is shown to be threaded into an aperture which is integral with moveable jaw 14 it is understood by one skilled in the art that other attachment means may be used. For example adjusting screw 30 may be pinned into moveable jaw 14. Because screw 30 and moveable jaw 14 are separate components the adjustable wrench of this invention can be easily assembled and broken or damaged parts can be easily replaced.

The movement of adjusting screw 30 and hence moveable jaw 14 is controlled by a thumbwheel 28. As can be seen from FIG. 3 thumbwheel 28 has an internal threaded aperture 36 through which is threaded adjusting screw 30.

From FIGS. 1 and 4 it can be seen that between elongated slot 16 and handle portion 8, the wrench of this invention incorporates a thumbwheel opening 38. As is explained above, the sides of elongated slot 16 incorporate opposing interlocking surfaces which support moveable jaw 14 during usage. In contrast, sides 39 and 41 of thumbwheel aperture 38 do not incorporate interlocking surfaces but instead are approximately parallel with each other. The width of adjusting thumbwheel aperture 38 is slightly wider than the top of interlocking slot 16 and the width of moveable jaw interlocking end 32. This arrangement provides for a means whereby the wrench of this invention can be assembled and more particularly whereby moveable jaw 14 can be assembled into head portion 6. The lateral edges of opening 38 extend slightly beyond the lateral edges of elongated slot 16, thereby making adjusting thumbwheel aperture 38 slightly wider than elongated slot 16. This increase in width of adjusting thumbwheel aperture allows moveable jaw 14 to be inserted into adjusting thumbwheel aperture 38 during assembly. Once moveable jaw 14 is positioned in adjusting thumbwheel aperture 38, it is moved forward in elongated slot 16 in order to allow the respective interlocking surfaces to engage each other. Adjusting thumbwheel 28 is then positioned in aperture 38 and adjusting screw 30 is then threaded through adjusting thumbwheel 28 and into moveable jaw 14 where it is secured. By this means, the assembly of the wrench of this invention is effected.

Adjusting thumbwheel 28 is positioned in a thumbwheel opening 38. The diameter of adjusting thumbwheel 28 is slightly larger than the narrowest width of slot 16, therefore the edges of thumbwheel 28 bias against the edges of adjusting thumbwheel aperture 38 when forces parallel to the axis of screw 36 are applied to adjusting thumbwheel 28. Adjusting thumbwheel 28 is captive in adjusting thumbwheel aperture 38. Because it is captive when the edges of adjusting thumbwheel 28 are biased against the edges of adjusting thumbwheel aperture 38 moveable jaw 14 is caused to move in relation to adjusting thumbwheel aperture 38 and fixed jaw 12. As a result of this movement adjustable wrench 2 can be adapted to engage hex fastener heads of various sizes. The outer circumference of adjusting thumbwheel 28 has a plurality of grooves which allows it to be easily gripped.

The above described structure produces an adjustable wrench which is strong and convenient to use. By the simple act of rotating adjusting thumbwheel 28 the wrench can be readily adapted to different size hex heads. Further all moveable parts are supported by head portion 6. That is, moveable jaw 14 is supported by elongated slot 16 and by cooperation of the opposing interlocking surfaces. Adjusting screw 30 is supported by head portion 6 as a result of its passage through aperture 44.

The terminal end of adjusting screw 30 is further provided with an Allen head hex aperture 46. When an Allen wrench is placed in aperture 46 it can engage hex aperture 46. Adjusting screw 30 can be rotated in order to assemble the components of head portion 6 together or to allow these components to be disassembled in order to replace a damaged or broken component. Hence it can be seen that the subject wrench can be easily disassembled and reassembled for servicing. It is understood by one skilled in the art that aperture 46 may be a screw slot which is adapted to receive a Phillips, slotted, or other screw driver. It is understood by one skilled in the art that aperture 46 may be a screw slot which is adapted to receive a Phillips, slotted, or other screw driver.

For the reasons as set forth herein the subject invention results in a superior reversible adjustable wrench. From the above description and from FIGS. 1 to 8, it can be seen that the subject invention can be used to produce a wide variety of reversible adjustable wrenches. It is understood by one skilled in the art that this invention is not limited to the embodiments as described and illustrated herein above.

The above description and drawings are illustrative only since modifications could be made without departing from the present invention, the scope of which is to be limited only the following claims.

What is claimed is:

1. An improved adjustable wrench having a handle portion and a jaw portion extending therefrom, the jaw portion having a jaw slot, a fixed jaw at one end of the jaw slot, a cooperating movable jaw slidable along the jaw slot and an adjusting means, the moveable jaw and the jaw slot having interlocking surfaces to retain the moveable jaw in longitudinal, slidable engagement along the jaw slot, wherein the improvement comprises:

an aperture formed at the opposite end of and opening into the jaw slot, the aperture being larger than the interlocking portion of the moveable jaw to permit the moveable jaw to be received in the aperture and then slid into engagement with the jaw slot during assembly of the wrench and wherein the adjusting means comprises a threaded rod extending from the moveable jaw through the aperture and a thumbwheel engaging the rod and rotatably positioned in the aperture.

2. An adjustable wrench having a handle portion and a jaw portion extending therefrom, the jaw portion comprising:

(a) a fixed jaw;

(b) a cooperating moveable jaw;

(c) a jaw slot portion formed with an elongated jaw slot, the jaw slot having the fixed jaw near one end of an aperture adjacent and opening into the opposite end, the moveable jaw having an interlocking portion which is slidable along the jaw slot and also having surfaces which interlock with jaw slot surfaces to retain the moveable jaw in slidable engagement in the jaw slot, the aperture being larger than the interlocking portion of the moveable jaw to permit the moveable jaw to be received in the aperture and slid for the aperture into the jaw slot during assembly; and (d) an adjusting means engaging the moveable jaw for adjustably retaining the moveable jaw at a selected position against longitudinal movement away from the fixed jaw, the adjusting means having a threaded rod extending from the moveable jaw through the aperture and a thumbwheel engaging the rod, rotatably positioned in the aperture and having a diameter greater than the least width of said jaw slot surface.

3. An adjustable wrench in accordance with claim 2 wherein a bore is formed through the jaw portion coaxially with the threaded rod and extending from the aperture and away from the slot to permit insertion of the rod through the thumbwheel and into engagement with the moveable jaw.

4. An adjustable wrench in accordance with claim 3 wherein said jaws both protrude outwardly in the same direction from the wrench.

5. An adjustable wrench in accordance with claim 4 wherein the protruding portion of the moveable jaw also extends outwardly in opposite directions beyond the opposed interlocking walls of the slot to form a retaining shoulder and the interlocking surfaces include mating dovetail surfaces angled outwardly from the shoulder.

* * * * *